United States Patent [19]

Sadakata et al.

[11] Patent Number: 4,741,692

[45] Date of Patent: May 3, 1988

[54] BURNER IGNITER WITH A CERAMIC HEATER

[75] Inventors: Tomohiko Sadakata; Shigeyoshi Kawano, both of Kure, Japan

[73] Assignee: Babcock-Hitachi Kabushiki Kaisha, Tokyo, Japan

[21] Appl. No.: 782,624

[22] Filed: Oct. 1, 1985

[30] Foreign Application Priority Data

Oct. 2, 1984 [JP] Japan ..... 59-205500

[51] Int. Cl.[4] ..... F23Q 7/06

[52] U.S. Cl. ..... 431/258; 431/13; 219/270; 123/145 A; 338/330

[58] Field of Search ..... 431/23, 66, 258, 262, 431/13, 18, 254, 259, 260, 263; 219/270, 553; 338/330; 123/145 A; 340/640

[56] References Cited

U.S. PATENT DOCUMENTS

| | | | |
|---|---|---|---|
| 3,412,290 | 11/1968 | Hempson | 431/258 |
| 3,875,476 | 4/1975 | Crandall et al. | 431/258 X |
| 3,875,477 | 4/1975 | Fredriksson et al. | 431/66 X |
| 4,207,053 | 6/1980 | Turner et al. | 431/258 X |
| 4,322,604 | 3/1982 | Kawamura et al. | 338/330 X |
| 4,432,722 | 2/1984 | Bohan et al. | 431/66 X |
| 4,475,029 | 10/1984 | Yoshida et al. | 219/270 |
| 4,483,284 | 11/1984 | Andreasson | 123/145 A X |
| 4,486,651 | 12/1984 | Atsumi et al. | 219/553 |
| 4,493,298 | 1/1985 | Kawamura | 123/145 A |

*Primary Examiner*—Margaret A. Focarino
*Attorney, Agent, or Firm*—Armstrong, Nikaido, Marmelstein & Kubovcik

[57] ABSTRACT

In a burner igniter using a ceramic heater, the resistance of the ceramic heater is detected to perform feedback control so that the temperature of the heater is maintained substantially constant to prevent both misfiring and overheating, while rapid temperature rise can also be obtained. The resistance value detected by a bridge circuit is fed to a proportional-integral controller which produces a control signal, while the current fed to the ceramic heater is also detected. The control signal and another signal indicative of the current to the ceramic heater are used to control a power source of the ceramic heater so that the current to the ceramic heater is controlled. A monitoring circuit responsive to both the resistance of the ceramic heater and the current fed to the ceramic heater may be added to warn a user that the life of the ceramic heater will soon end. The ceramic heater may comprise a portion having negative temperature coefficient, through which portion leak current would flow when the temperature of the ceramic heater rises so as to prevent overheating.

23 Claims, 7 Drawing Sheets

BURNER IGNITER WITH A CERAMIC HEATER

BACKGROUND OF THE INVENTION

1. Field of the Invention

This invention relates generally to igniters of a burner, and more particularly to such an igniter using a ceramic heater.

2. Prior Art

Ceramic heater has recently been developed as a heat generator of an igniter of a burner. Although this newly developed ceramic heater provides various advantages when compared with conventional sheath heater, it is necessary to prevent the ceramic heater from overheating in view of life thereof. The prevention of overheating is not simple because the period of time required for ignition would be lengthened if the amount of heat generation or calorific value of the ceramic heater is reduced to avoid overheating. As is well known it is generally required for a heater of a burner that the period of time required for ignition is as short as possible in view of safety, while overheating should be avoided for ensuring long life of the heating element. This means that the characteristic of such a ceramic heater required as an igniter is contradictory to heat-generating characteristic of the same.

SUMMARY OF THE INVENTION

The present invention has been developed in order to remove the above-described drawbacks inherent in the conventional igniters for burners.

It is, therefore, an object of the present invention to provide new and useful igniter having a ceramic heater which is temperature controlled so that the temperature can be rapidly increased when energized and maintained at a given setting value without exceeding an upper limit to prevent overheating.

According to a feature of the present invention the resistance of the ceramic heater is detected to perform feedback control so that the temperature of the heater is maintained substantially constant to prevent both misfiring and overheating, while rapid temperature rise can also be obtained. The detected resistance value is fed to a proportional-integral controller which produces a control signal, while the current fed to the ceramic heater is also detected. The control signal and another signal indicative of the current to the ceramic heater are used to control a power source of the ceramic heater so that the current to the ceramic heater is controlled. A resistance-monitoring circuit responsive to both the resistance of the ceramic heater and the current fed to the ceramic heater may be added to warn a user that the life of the ceramic heater will soon end. The ceramic heater may comprise a portion having a negative temperature coefficient, through which a leakage current would flow when the temperature of the ceramic heater rises so as to prevent overheating.

BRIEF DESCRIPTION OF THE DRAWINGS

The object and features of the present invention will become more readily apparent from the following detailed description of the preferred embodiments taken in conjunction with the accompanying drawings in which.

The same or corresponding elements and parts are designated at like reference numerals throughout the drawings.

DETAILED DESCRIPTION OF THE INVENTION

Prior to describing the preferred embodiment of the present invention, known heaters will be discussed for a better understanding of the present invention.

Figure 1:
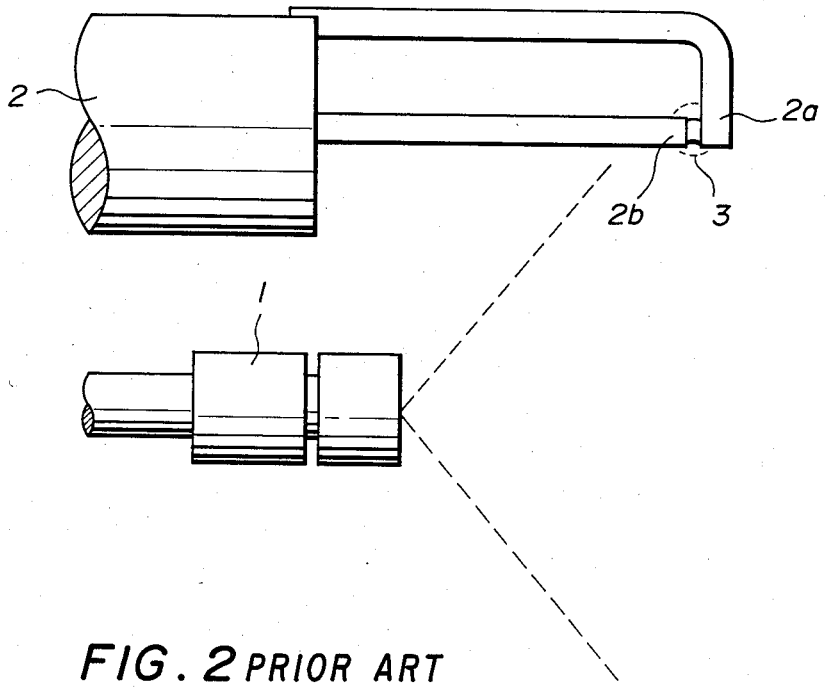
FIG. 1 PRIOR ART
FIG. 1 is a schematic view showing a conventional spark-discharge type ignition plug for a burner.
Figure 2:
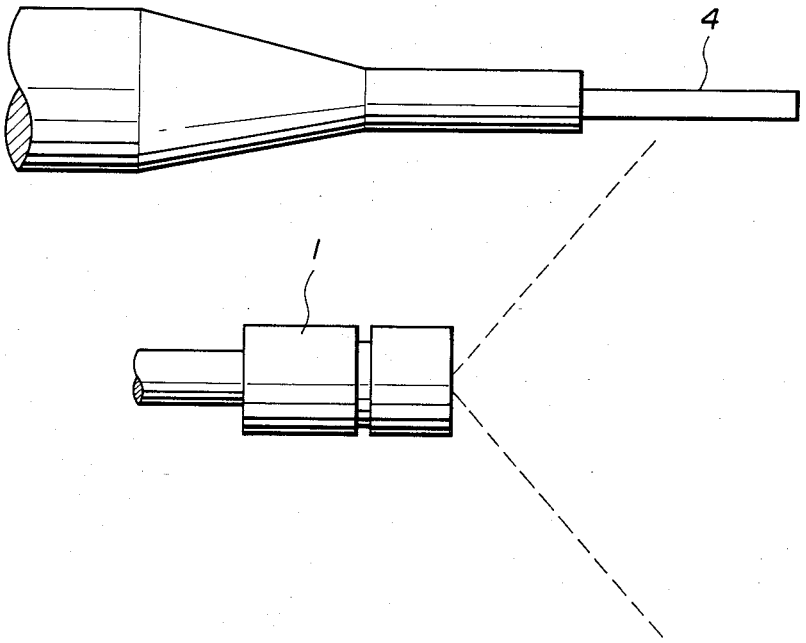
FIG. 2 PRIOR ART
FIG. 2 is a schematic view showing a known ignition plug for a burner, using a ceramic heater.

Conventional igniters for burners are generally divided into two types, one using spark discharge occurring at a spark plug, and the other using a heat-generator, such as a sheath heater, ceramic heater or the like. FIGS. 1 and 2 respectively illustrate igniters of these two types. More specifically, FIG. 1 shows a spark igniter 2 located close to a nozzle 1 from which fuel to be ignited is sprayed. The igniter 2 comprises two electrodes 2*a* and 2*b* arranged to be opposed with a given space so as to generate a spark 3 therebetween when energized. FIG. 2 shows a heat-generating type igniter located close to a nozzle 1. The igniter of FIG. 2 comprises a heat-generator 4 such as a sheath heater or a ceramic heater.

Although the spark type igniter has an advantage that a period of time required for ignition is short, there are various drawbacks such that an ignition region is small, spark discharge fails when there is an alien substance between electrodes of the spark plug, or explosion-proof type is necessary due to high voltage to be applied to the spark plug. On the other hand, when a heat-generating type igniter using a metallic resistor, such as a sheath heater, while the above-mentioned problems do not occur, the period of time required for ignition is relatively long, and therefore, there is a problem relating to safety in the case of a burner of the type arranged to spray a large amount of fuel as in a power boiler.

Recently, a so-called ceramic heater has been developed in order to remove the above-mentioned drawbacks. In detail, a ceramic heater using composite conductive ceramics of SiC and $ZrB_2$ as its heat generating body exhibits superior characteristics as an igniter in connection with heat-resistance, ignition region, operating voltage and so on. One example of such a ceramic heater is disclosed in Japanese Patent Provisional Publication No. 60-82723.

Figure 3:
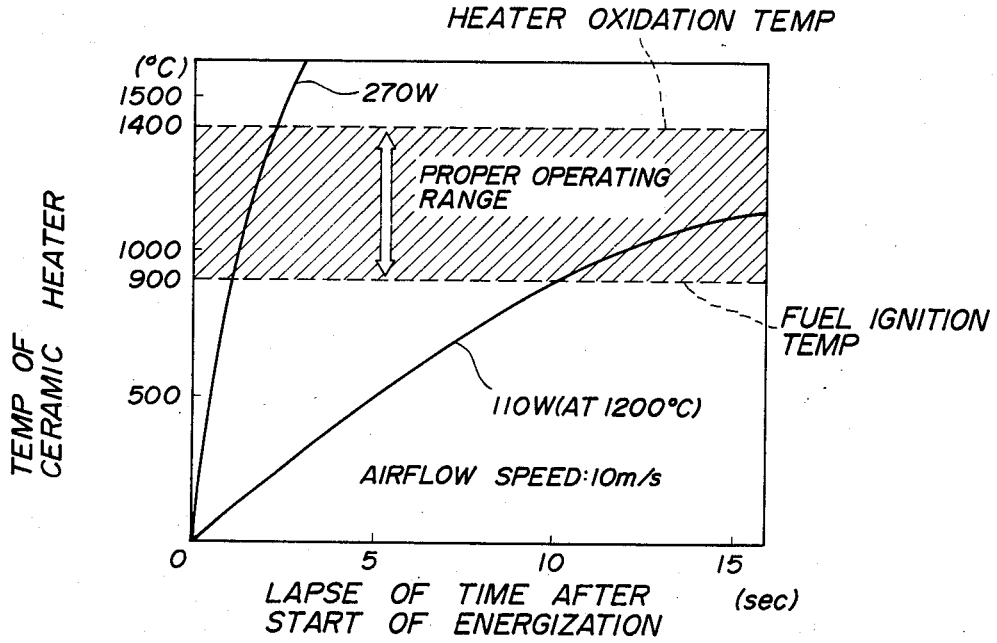
FIG. 3 is a graph showing heat generating characteristic of a ceramic heater.

FIG. 3 shows the relationship between energizing duration and heater temperature when a ceramic heater is used. For simplicity, the temperature of a ceramic heater will be simply referred to as temperature throughout the specification unless indicated to the contrary. In the illustrated example, it is assumed that a minimum temperature for igniting fuel is 900° C. and therefore, the temperature of the ceramic heater has to be above 900° C. Furthermore, it is also assumed that the material of the ceramic heater starts deteriorating due to oxidation when being overheated beyond 1400° C. Therefore, it is necessary to maintain the temperature of a ceramic heater between these two temperatures 900° C. and 1400° C. Thus the hatched area in the graph of FIG. 3 indicates a proper operating temperature range of the ceramic heater. In FIG. 3, the temperatures plotted along Y distance includes not only heat generated by the ceramic heater per se but also heat caused from flame. This applies to similar diagrams of FIGS. 5, 10, 11 and 12.

In FIG. 3, two curves are shown, one indicating a case that the heating power of a ceramic heater is 110 W and the other indicating a case that the heating power is 270 W at 1200° C. in both cases. As shown from the comparison between these two curves, when heating power of a ceramic heater is large, although the period of time required for ignition is short, there is a problem that the heater is overheated to deteriorate. On the contrary, when heating power is small, although overheating can be prevented, the period of time required for ignition is long. As discussed at the beginning of the specification, it is required to shorten the time required for ignition in view of safety, while it is also necessary to prevent overheating for ensuring long life.

Figure 4:
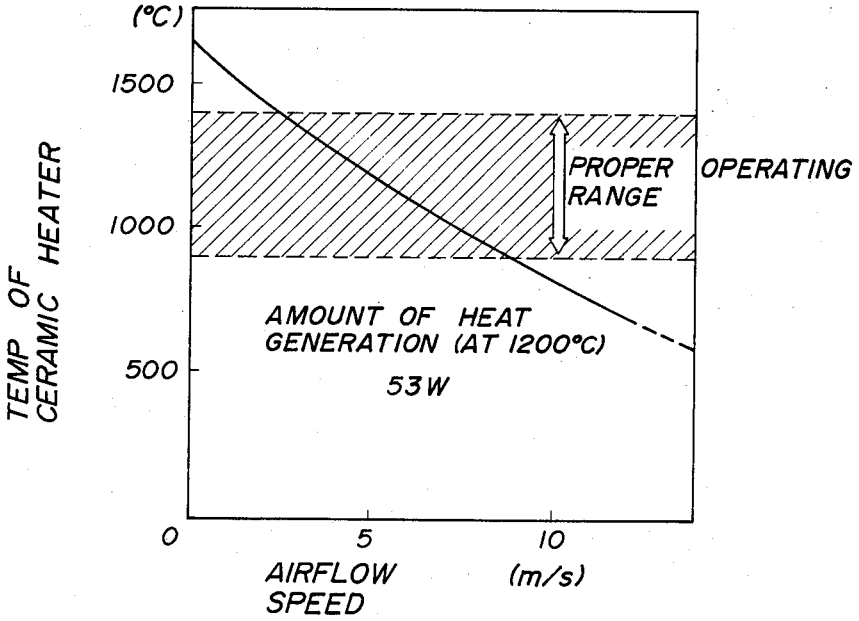
FIG. 4 is a graph showing the influence of airflow speed on the temperature of a ceramic heater.

FIG. 4 is a graph showing the relationship between the temperature of a ceramic heater and airflow rate or speed. As shown from this graph, the temperature of the ceramic heater changes considerably depending on airflow speed, and thus the increase in speed of airflow within a burner results in a drop in the temperature of the ceramic heater even though the amount of heat generation or calorific value is unchanged. As a result, misfiring is likely to occur. On the other hand, in the case that the airflow speed is reduced, the temperature of the ceramic heater increases to deteriorate the heater sometimes.

Figure 5:
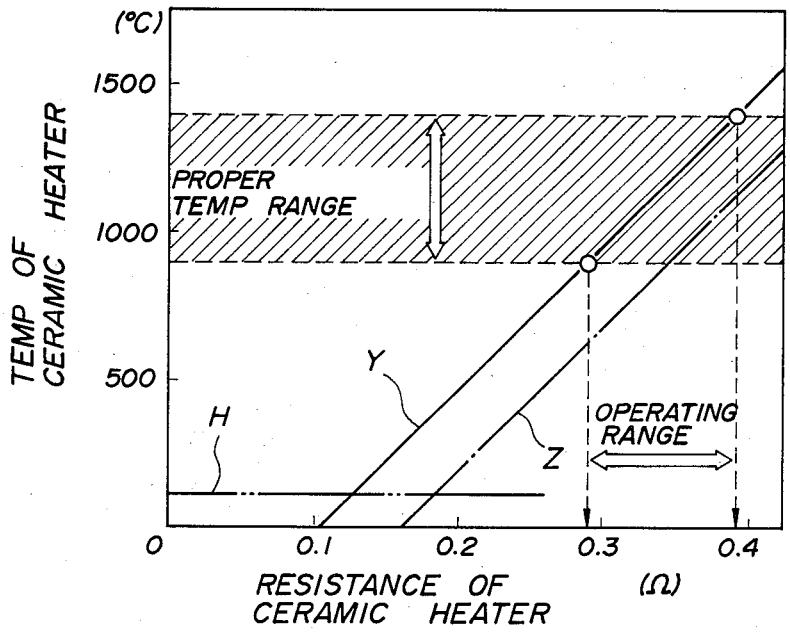
FIG. 5 is a graph showing the relationship between the resistance and temperature of a ceramic heater.

FIG. 5 is a graph showing the relationship between the temperature of a ceramic heater and electrical resistance of the same where the heater is made of composite conductive ceramics of SiC and $ZrB_2$. As indicated by a straight line Y in FIG. 5, the resistance of such a ceramic heater increases in proportion to the temperature. Therefore, as the illustrated line Y indicates, if the electrical power supplied from power source to the ceramic heater, i.e. calorific value, is controlled so that the resistance is between 0.29 ohms and 0.39 ohms, the temperature of the heater can be maintained within the proper operating temperature range, i.e. between 900° C. and 1400° C.

Figure 6:
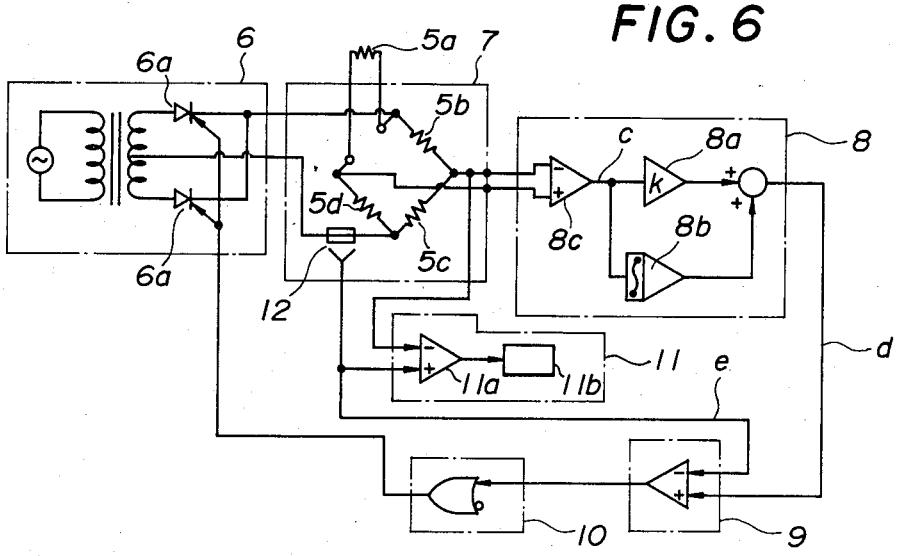
FIG. 6 is a schematic circuit diagram showing an embodiment of the igniter for a burner according to the present invention.

FIG. 6 is a circuit diagram of an embodiment of igniter for a burner according to the present invention. The igniter of FIG. 6 comprises a ceramic heater 5*a* of the above-described type, an electric power source 6 for energizing the ceramic heater 5*a*, a detecting circuit 7 having a bridge circuit for detecting the resistance of the ceramic heater 5*a*, a control circuit 8 responsive to the detecting circuit 7 for producing a control signal which will be used for controlling heat generation at the ceramic heater 5*a*, a current-control circuit 9 responsive to a signal "e" indicative of the amount of current fed to the ceramic heater 5*a* and to the control signal "d" from the control circuit 8, a phase-control circuit 10 for performing phase control of thyristers 6*a* included in the power source 6, and a resistance-monitoring circuit 11 for evaluating the life of the ceramic heater 5*a* using a signal "a" from the terminal "a" for indicating the voltage across the ceramic heater 5*a*, and also the signal "e" indicative of the amount of current fed to the ceramic heater 5*a*. Although it has been described that the bridge circuit is included in the detecting circuit 7, the structure of the bridge circuit is such that three resistors 5*b*, 5*c* and 5*d* each having a small temperature coefficient are provided to form the bridge circuit together with the ceramic heater 5*a* as shown. As will be clear from the following description, the control circuit 8, the current-control circuit 9, and the phase-control circuit 10 constitute a feedback path to perform feedback control.

Figure 7:
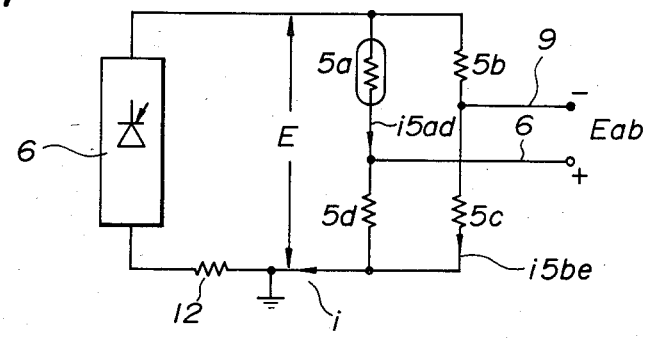
FIG. 7 is an explanatory diagram for the description of the operating principle of the detecting circuit shown in FIG. 6.

FIG. 7 is an explanatory diagram for the description of the operating principle of the detecting ciruit 7 shown in FIG. 6. An output voltage difference $E_{ab}$ from the detecting circuit 7 is given by Eq. (1):

$$E_{ab} = \frac{R_{5d}}{R_{5a} + R_{5d}} \cdot E - kE \tag{1}$$

$$\text{wherein } k = \frac{R_{5c}}{R_{5b} + R_{5c}} \tag{2}$$

From Eqs. (1) and (2) we obtain:

$$E_{ab} = \frac{(1 - k)R_{5d} - k \cdot R_{5a}}{R_{5a} + R_{5d}} \cdot E \tag{3}$$

In the circuit arrangement of FIG. 6, the amount of heat energization by the ceramic heater 5*a* is controlled so that $E_{ab}=0$ thereby controlling the resistance $R_{5a}$ of the ceramic heater 5*a*. Therefore, the resistance $R_{5a}$ of the ceramic heater 5*a* is given by the following Eq. (4):

$$R_{5a} = \frac{1 - k}{k} \cdot R_{5d} \tag{4}$$

When we use 0.1 for "k", $R_{5a}=9\times R_{5d}$ results.

The resistor 5*d* is used as one having a sufficiently large capacity so as to prevent temperature increase thereof due to the current flowing therethrough. Furthermore, a resistor having a small temperature coefficient should be used for 5*d* so that temperature variation hardly affects the resistance value. On the other hand, the resistors 5*b* and 5*c* determine the value of "k" in the above equations, and as will be understood from Eq. (2) it is unnecessary to use resistors having small temperature coefficient for 5b and 5c as long as the temperature coefficient thereof is substantially equal to each other.

Since the resistance $R_{5a}$ of the ceramic heater 5a is small at the very beginning of heating as illustrated in FIG. 5, the above Eq. (3) would be $E_{ab}>0$, and thus the current flowing through the ceramic heater 5a will be transformed into a current-increase command signal by the control circuit 8 as will be described hereinafter.

In addition, since $R_{5b}$, $R_{5c}>>R_{5a}$, $R_{5d}$, then $i_{5bc}<<i_{5ad}$ wherein $i_{5bc}$ and $i_{5ad}$ are currents flowing respectively through the resistor 5c and the ceramic heater 5a. Finally, the current "i" flowing from the power source 6 into the bridge circuit nearly equals $i_{5ad}$, and this current "i" is regarded as the current flowing through the ceramic heater 5a. This current "i" is detected as the current to the ceramic heater 5a, and is represented by the signal "e" produced by the current-detecting circuit 12.

Figure 8:
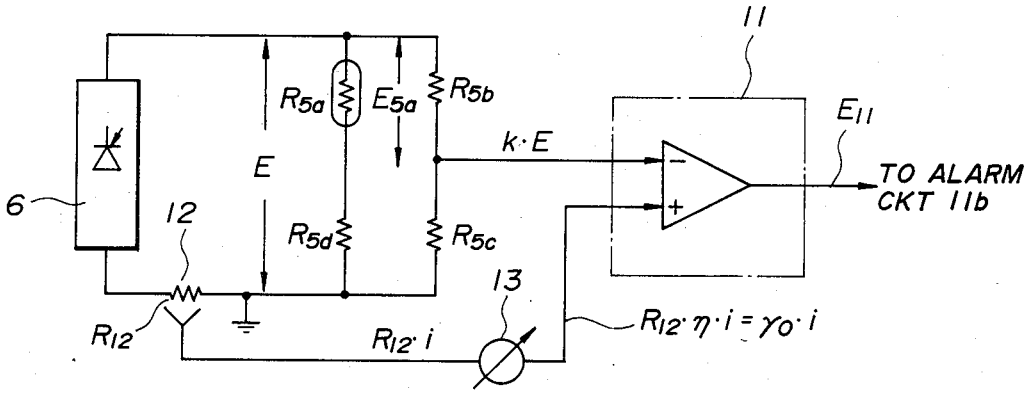
FIG. 8 is an explanatory diagram for the description of the operating principle of the resistance-monitoring circuit shown in FIG. 6.

The resistance-monitoring circuit 11 comprises a comparator 11a and an alarm circuit 11b responsive to the comparator 11a. More specifically, the comparator 11a is responsive to the signal "a" indicative of the resistance of the ceramic heater 5a and to another signal "e" indicative of the current to the ceramic heater 5a. The alarm circuit 11b may be a buzzer, an LED or the like which emits sound or light as an alarm signal. The structure as well as the operating principle of the resistance-monitoring circuit 11 will be described hereinbelow. FIG. 8 is an explanatory diagram for describing the operational principle of the resistance-monitoring circuit 11. An output voltage $E_{11}$ from the comparator 11a of the resistance-monitoring circuit 11 is given by the following Eq. (5):

$$E_{11} = \gamma_o \cdot i - kE = k\left\{\frac{\gamma_o}{k} \cdot i - E\right\} \tag{5}$$

Since $R_{5a}>>R_{5d}$, assuming that $E \simeq E_{5a}$, then $E_{11}$ is given by the following Eq. (6):

$$E_{11} = k\left\{\frac{\gamma_o}{k} \cdot i - E_{5a}\right\} \tag{6}$$

On the other hand, because $E_{5a}=R_{5a} \cdot i$, the value of $E_{11}$ is given by Eq. (7):

$$E_{11} = k\left\{\frac{\gamma_o}{k} - R_{5a}\right\} i = k(R_o - R_{5a})i \tag{7}$$

In the above, using $R_o=\gamma_o/k$ as an allowable upper limit resistance, when $R_{5a}>R_o$ as the result of the use of the ceramic heater 5a, then $E_{11}<0$. This state is detected by the comparator 11a to drive the alarm circuit 11b.

A coefficient $\eta$ to be set by the coefficient setter is given by Eq. (8):

$$\eta=\eta_o(1+\beta \cdot Ta) \tag{8}$$

wherein Ta is an ambient temperature at the time of starting heat generation.

Therefore, we obtain:

$$R_o = \frac{\gamma_o}{k} = \frac{R_{12}}{k}\eta = \frac{\eta_o \cdot R_{12}}{k} \cdot (1 + \beta \cdot Ta) \tag{9}$$

This Eq. (9) indicates that Ro is corrected by the ambient temperature Ta.

Figure 9:
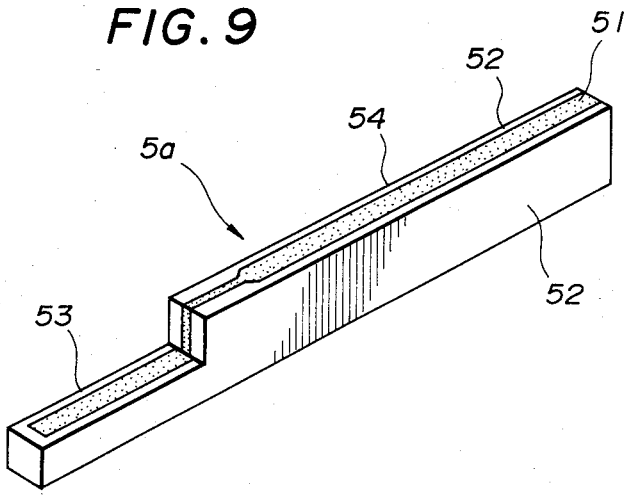
FIG. 9 is a perspective view of the ceramic heater used in FIG. 6.

FIG. 9 is a perspective view of the ceramic heater 5a shown in FIG. 6. The ceramic heater comprises conductive ceramic layers 52 formed on both surfaces of an intermediate insulating layer 51. The reference 53 indicates a heat-generating portion whose cross-sectional area is made smaller than that of the remaining terminal portion 54 so that the electrical resistance at the heat-generating portion 53 is relatively large. The insulating layer 51 may be made of aluminum nitride (AlN) for instance. The conductive ceramic layer 52 is made of a mixture of silicon carbide (SiC 47.0 weight %) as a base, zirconium boride ($ZrB_2$ 51.5 weight %) as a conductive member, and aluminum oxide ($Al_2O_3$ 1.5%) as a sintering aid.

The circuit arrangement of FIG. 6 operates as follows. Let us assume that the ceramic heater 5a is to be energized by the power source 6 to increase the temperature of the ceramic heater 5a up to 1200° C., which is a setting temperature, from a room temperature. It is assumed that the resistance of the ceramic heater 5a at a room temperature is 0.11 ohms. Since the ceramic heater 5a is one of four resistors constituting the bridge circuit included in the detecting circuit 7, a voltage difference corresponding to the difference between the resistance (0.11 ohms) at a room temperature and the resistance (0.35 ohms) at the setting temperature of 1200° C. will be developed between terminals "a" and "b" of the detecting circuit 7 when the circuit of FIG. 6 starts operating. This voltage difference between these terminals "a" and "b" is fed to the control circuit 8 so that the ceramic heater 5a starts generating heat with current thereto being increased in accordance with the detected voltage difference.

The control circuit 8 comprises an operational amplifier 8c responsive to the voltage difference between the terminals "a" and "b", a proportional controller 8a, and an integrator 8b so as to perform well known proportional-integral control. Therefore, the control circuit 8 produces an output signal "d" in accordance with a desired temperature-rising speed of the ceramic heater 5a. This control signal "d" for increasing current on the basis of the heater resistance change is referred to as a current-increase command signal hereinafter. The current-increase command signal and another signal "e" indicative of the current "i" to the ceramic heater 5a from a heater-current detector 12 are both fed to the current-control circuit 9. The current-control circuit 9 determines the amount of current to be fed to the ceramic heater 5a through comparison between these two input signals "d" and "e". An output signal from the current control circuit 9 is fed to a phase controller 10 which controls the phase angle of a trigger signal to be applied to the gate of each of the thyristers 6a and 6b both included in the power source circuit 6. In the above case, the thyristers 6a and 6b are controlled so that the current to the ceramic heater 5a is increased to raise the temperature thereof.

When the setting temperature, i.e. 1200° C. in this case, is reached, the voltage between terminals "a" and "b" equals zero, and thus the current-increase command signal "d" from the control circuit 8 decreases until it corresponds to a current necessary for maintaining the setting temperature of the ceramic heater 5a. The current-control circuit 9 causes the power circuit 6 via the phase-control circuit 10 to reduce the current fed to the ceramic heater 5a. In this way, since it is possible to reduce the heating power of the ceramic heater 5a when the temperature thereof reaches a desired temperature, deterioration of the ceramic heater 5a due to overheating can be prevented.

In the case that the temperature of the ceramic heater 5a exceeds the setting temperature, the resistance of the ceramic heater 5a assumes a value larger than 0.35 ohmns, and thus a voltage appears between the terminals "a" and "b" where the voltage is of opposite polarity to the case of temerature increase. As a result, the control circuit 8 produces a current-decrease command signal and thus the current control circuit 9 is driven by this command signal so as to reduce the current fed to the ceramic heater 5a in a similar manner as described in connection with temperature increase. Thus, the temperature of the ceramic heater 5a is lowered. In this way, the temperature of the ceramic heater 5a can be maintained constant even if the airflow speed around the heater 5a changes as shown in FIG. 4. While the current to the ceramic heater 5a is detected by the current-detecting circuit 12 in the illustrated embodiment of FIG. 6, a voltage across the resistor 5d may be measured so as to obtain the current to the ceramic heater 5a.

The effect of the present invention will be apparent from the following comparison between heat generation by a ceramic heater powered by conventional customary power source and heat generation by the same ceramic heater powered by the circuit arrangement of FIG. 6.

Figure 10:
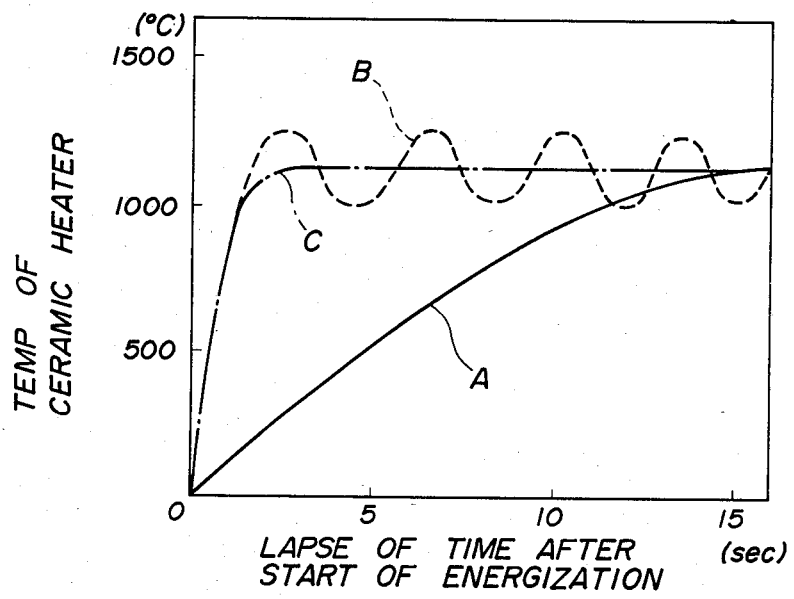
FIG. 10 is a graph showing heat-generating characteristics of a ceramic heater driven by various power sources.

FIG. 10 shows the results of such experiments. The ceramic heater 5a, which is under the same condition, is energized to generate heat so that the temperature increases from room temperature to a setting temperature of 1200° C. by three different power source circuits respectively. A curve A shows temperature rise characteristic obtained when the ceramic heater 5a is driven by a constant-voltage power source without temperature control. A curve B shows temperature rise characteristic obtained when the ceramic heater 5a is driven by a power source involving a proportional controller which controls the voltage applied to the ceramic heater. A curve C shows temperature rise characteristic obtained when the ceramic heater 5a is driven by a power source controlled according to the present invention.

As will be understood from the comparison between these curves A, B and C, although the constant-voltage power source is simple in construction, it takes a long period of time, for instance over 15 seconds, until the setting temperature is reached since the calorific value is designed to be a small value from the beginning of heat generation so that the setting temperature of 1200° C. is not exceeded. When such an igniter requiring a long period of time for ignition is used, it is difficult to determine injection timing of fuel to be supplied to ignition torch so that the fuel injection timing coincides with ignition timing. Therefore, this type of power source suffers from a problem relating to the safety of the igition torch.

On the other hand, in the remaining type of power source, since the calorific value is changed in correspondence with the temperature of the heater, it is possible to increase the temperature rise speed by increasing the calorific value at the beginning of heat generation so that the setting temperature is reached within about 2.5 seconds, while the calorific value is made small around the setting temperature to prevent overheating of the ceramic heater 5a.

In the above, when the second-mentioned power source is used, the operation is unstable as indicated by the curve B in FIG. 10, and the temperature fluctuates in a range of 100° to 200° C. centering the setting temperature of 1200° C. The reason of such fluctuation is that the proportional control provides instantaneous control operation while the response of a ceramic heater requires about 3 seconds, and thus the amount of change in the power condition is apt to run to excess. Another reason is that since voltage control is employed, even though the voltage is changed, the current flowing through the heater would be superfluous or insufficient with respect to a proper value because the resistance of the ceramic heater is either greater or smaller than that at the setting temperature. The repetition of such unstable operation would result in an uncontrollable state. Moreover, such unstable operation gives periodic temperature changes to the ceramic heater, and thus the life of the ceramic heater would be shortened due to cracks occurring as the result of thermal fatigue.

On the contrary, when the power source according to the present invention is used, since the control operation is performed at a speed corresponding to the response speed of the ceramic heater using proportional-integral control, and since the current to the ceramic heater is controlled, a suitable current according to the control signal from the control circuit 8 is obtained. Therefore, the temperature of the ceramic heater driven by the circuit arrangement of FIG. 6 is extremely stable such that only negligibly small fluctuation appears centering the setting temperature of 1200° C.

Figure 11:
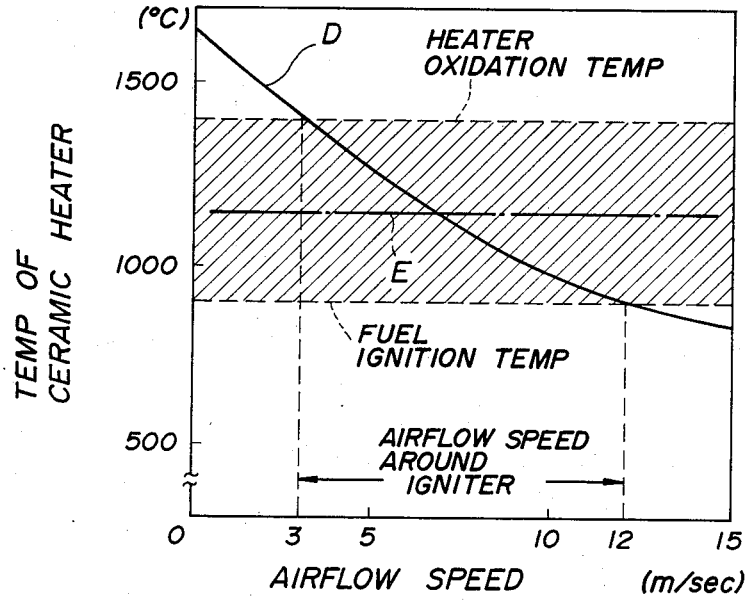
FIG. 11 is a graph showing the influence of airflow speed on the temperature of a ceramic heater driven by a conventional power source and a power source according to the present invention respectively.

While it has been described in connection with the operation of power source on heating, the environmental conditions of an igniter of a burner always drastically change. For instance, in the case of a burner of a boiler, the airflow speed changes in a range from 3 to 12 m/sec. The influence of airflow speed on the temperature of a ceramic heater will be considered with reference to FIG. 11. A curve D in FIG. 11 shows temperature variation with respect to the airflow speed where a ceramic heater is driven by a power source which is not temperature controlled, while another curve E shows the temperature characteristics of a ceramic heater driven by the circuit arrangement of FIG. 6.

As shown from curve D, when the airflow speed is reduced to 3 m/sec in a power source which is not temperature controlled, the ceramic heater is overheated since the heat loss of the ceramic heater is small with such a low speed of airflow. On the contrary, when the airflow speed is over 12 m/sec, the heat loss increases accordingly, and thus the temperature of the ceramic heater drops below the minimum fuel ignition temperature, i.e. 900° C., resulting in misfiring sometimes.

Turning to the circuit arrangement according to the present invention, since the calorific value of the ceramic heater 5a is controlled in accordance with the heat loss due to airflow, the temperature of the ceramic heater 5a is prevented from varying even if the airflow speed is changed. Therefore, deterioration of the ceramic heater caused from overheating is avoided, while misfiring caused from dropped temperature is also prevented.

Figure 12:
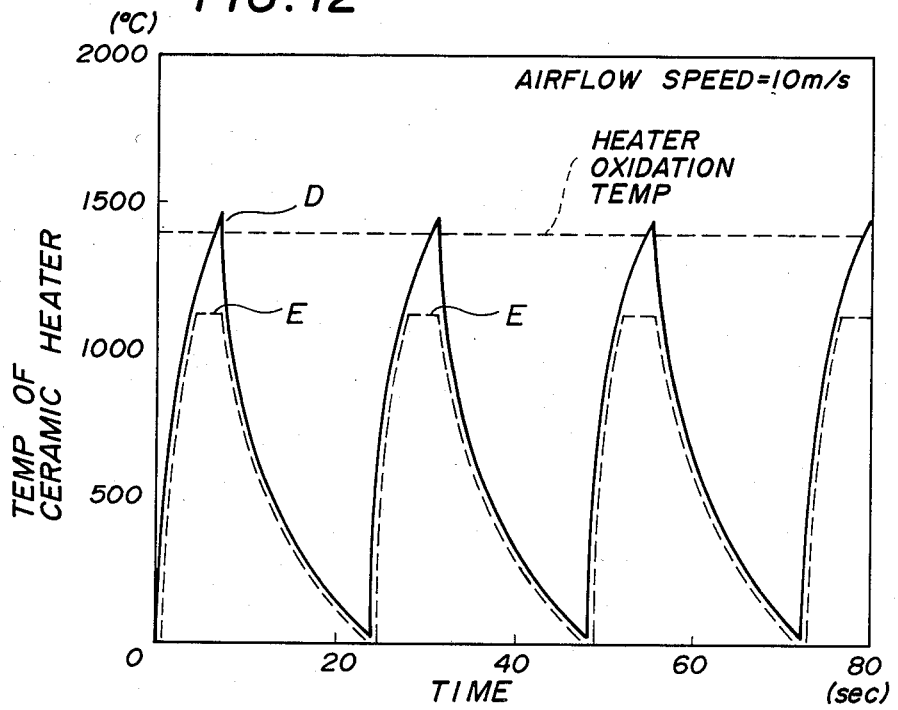
FIG. 12 is a graph showing heat-generating pattern resulted from repetitive energization test of a ceramic heater using a conventional power source and a power source according to the present invention respectively.
Figure 13:
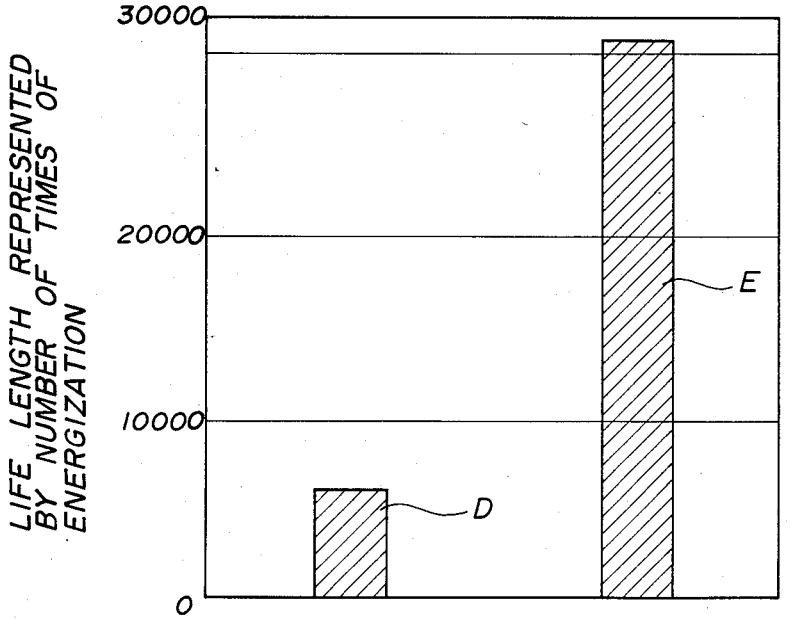
FIG. 13 is a graph showing life characteristic of a ceramic heater obtained as the result of the test of FIG. 12.

FIGS. 12 and 13 are graphs showing how the life of the ceramic heater 5*a* is lengthened by the present invention. FIG. 12 shows temperature variation obtained when a ceramic heater is heated repeatedly with a given heating pattern. In this experiment, energization is repeated such that enegization duration is 8 seconds and cooling duration is 16 seconds with temperature rise speed of 2 seconds to the minimum fuel ignition temperature of 900° C. In the case of a constant-voltage power source uncontrolled by the temperature, the temperature of the ceramic heater exceeds 1400° C., which is an oxidation-proof upper limit, approximately 7 seconds after the beginning of energization as indicated by a curve D. On the other hand, in the case of the circuit according to the present invention, the temperature does not exceed the setting temperature of 1200° C. as indicated by a curve E.

FIG. 13 shows the results of experiments of the repetitive energization according to the pattern of FIG. 12. It is assumed that the number of energization of the ceramic heater is evaluated as the life thereof. From the graph of FIG. 13, it is apparent that the life of the ceramic heater driven by the circuit arrangement according to the present invention is five times longer than that of the ceramic heater driven by the above-mentioned constant voltage power source.

From the above it will be understood that the use of the power source having circuit configuration according to the present invention lengthens the life of the ceramic heater. However, the life of the ceramic heater used as an igniter of a burner is apt to change depending on operating conditions. In the circuit configuration of the embodiment of FIG. 6, the resistance-monitoring circuit 11 is provided for monitoring the life of the ceramic heater 5*a* thereby preventing misfiring which will be caused from unexpected breakage of the ceramic heater 5*a*.

Figure 14:
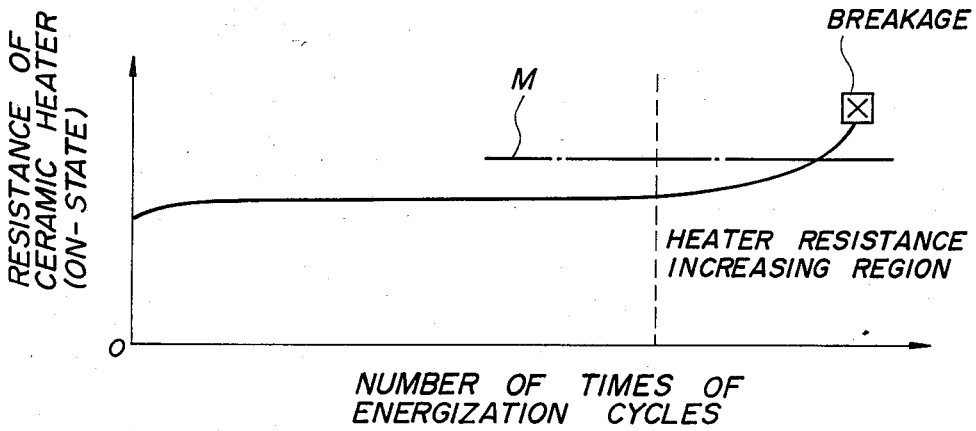
FIG. 14 is a graph showing the variation in the resistance of a ceramic heater through a repetitive energization test.

FIG. 14 is a graph showing the variation in resistance of the ceramic heater with respect to the number of times of energization. The resistance values are of the on-state of the ceramic heater. As understood from the illustrated curve, the resistance of the ceramic heater is kept substantially constant up to a given number of times of energization cycles, and there is a tendency that the resistance increases before the heater is broken (see breakage point indicated by the reference X). Therefore, if the resistance variation is monitored, the breakage of the ceramic heater can be predicted. The resistance-monitoring circuit 11 is provided for warning when the resistance exceeds a predetermined value (see level M) to inform a user of the igniter that the life of the ceramic heater 5*a* will soon end.

The resistance-monitoring circuit 11 detects such an increase in the resistance of the ceramic heater 5*a* caused from the deterioration using the resistance value represented by the voltage at the terminal "a" and the value of current fed to the ceramic heater 5*a*, and warns by way of a sound alarm or visual indication. The resistance-monitoring circuit 11 is arranged to operate for only a short period of time, such as 0.5 second, after the start of heat generation. The reason why the resistance-monitoring circuit 11 is operated for only such a short period of time will be described hereinbelow. Turning back to FIG. 5, a line Z indicates temperature vs resistance characteristic of a deteriorated ceramic heater. Namely, the original line Y has been shifted rightward due to deterioration. In order to detect such shifting or variation, the resistance of the ceramic heater 5*a* has to be detected in correspondence with the temperature thereof. Since the temperature of the ceramic heater 5*a* at a time immediately after the start of energization is substantially equal to the ambient temperature, this ambient temperature can be detected separately. Therefore, if the resistance of the ceramic heater 5*a* is measured immediately after the start of energization, the difference between a normal resistance represented by the line Y and an abnormal resistance represented by the line Z can be detected as the difference between resistances respectively corresponding to the intersections between line H and lines Y and Z. Using such an alarm, it is possible to remarkably enhance the reliability of the igniter by replacing the ceramic heater with a new one and by checking the igniter.

Figure 15:
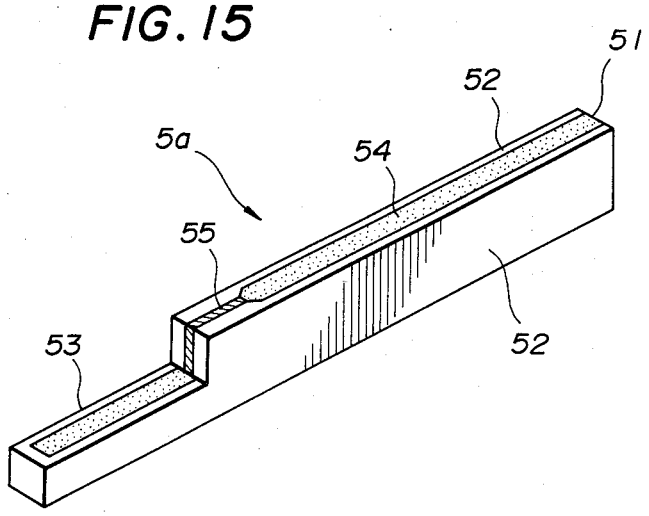
FIG. 15 is a perspective view of a modification of the ceramic heater of FIG. 9.

FIG. 15 is a perspective view showing a modification of the ceramic heater 5*a*. This ceramic heater 5*a* differs from the ceramic heater of FIG. 9 in that a portion 55 of the insulating layer 51 positioned between the terminal portion 54 and the heating portion 53 is now formed of a ceramic layer 55 having a negative temperature coefficient. In other words, this portion 55 located at the terminal portion 54 whose cross-sectional area is larger than that of the heating portion 53 is not any more an insulator but a resistor whose resistance decreases as temperature rises. As a ceramic material having such negative temperature coefficient are used SiC composition, $SiC\text{-}Si_3N_4$ composition, AgI composition, $Bi_2O_3$ composition, $ZrO_2$ composition, CaO composition, $ThO_2$ composition, $CeO_2$ composition, $HfO_2$ composition and so on.

As the result of arranging such a ceramic layer 55 having negative temperature coefficient to be parallel with the heat-generating portion 53, the resistance of the ceramic layer 55 is lowered when the heat-generating portion 53 is generating heat because the generated heat is transmitted to the ceramic layer 55. Therefore, a portion of the electrical current flowing through the heat-generating portion 53 now flows via the ceramic layer 55 as a leak current, and thus the current flowing via the heat-generating portion 53 is reduced to prevent the deterioration of the heat-generating portion 53 due to overheating. Therefore, if the ceramic heater 5*a* having the above-mentioned structure of FIG. 15 is used in the circuit of FIG. 6, the heater temperature can be further accurately controlled.

Although thyristers 6*a* are used in the circuit configuration of FIG. 6 so as to perform phase control, other semiconductor elements, such as transistors, may be used in place of the thyristers 6*a*.

From the foregoing, it will be understood that the temperature of the ceramic heater is maintained within a given range with a power source being controlled in accordance with the resistance of the ceramic heater. Therefore, overheating beyond a setting temperature is prevented even if rapid heating is performed such that the minimum ignition temperature is reached within several seconds, and thus the period of time required for raising temperature over the minimum ignition temperature can be reduced. As a result, the ignition timing can readily be coincided with the timing of fuel injection or spraying within a burner. Such coincidence prevents an explosion accident which may occur due to ignition timing lag.

Furthermore, since the heater temperature is kept constant even if environmental conditions of a ceramic heater are changed, misfiring caused from temperature drop and deterioration of the ceramic heater due to overheating can be effectively prevented.

Moreover, since the temperature of the ceramic heater can be maintained constant compared to the conventional arrangement, the occurrence of cracks due to thermal fatigue resulted from temperature variation can be prevented to lengthen the life of the ceramic heater.

The above-described embodiments are just examples of the present invention, and therefore, it will be apparent for those skilled in the art that many modifications and variations may be made without departing from the scope of the present invention.

What is claimed is:

1. A circuit arrangement for an igniter of a burner comprising:

(a) power source means arranged to control output current therefrom in accordance with a current control signal;

(b) a ceramic heater arranged to be energized by said power source means;

(c) resistance-detecting means for detecting the resistance of said ceramic heater;

(d) current-detecting means for detecting current fed from said power source means to said ceramic heater; and (e) feedback control means responsive to output signals from said resistance-detecting means and to said current-detecting means for producing a said current control signal which is fed back to said power source means for controlling the current to said ceramic heater.

2. An igniter of a burner as claimed in claim 1, wherein said current-detecting means comprises elements constituting a bridge circuit together with said ceramic heater.

3. An igniter of a burner as claimed in claim 1, wherein said power circuit comprises a semiconductor element arranged to be controlled by said feedback control means.

4. An igniter of a burner as claimed in claim 1, wherein said feedback control means comprises an integrator responsive to said output signal from said resistance detecting circuit.

5. An igniter of a burner as claimed in claim 1, further comprising a resistance-monitoring circuit for monitoring the life of said ceramic heater using the resistance of said ceramic heater.

6. An igniter of a burner as claimed in claim 1, wherein said ceramic heater comprises an insulating layer and conductive ceramic layers formed on both sides of said insulating layer, said conductive ceramic layers having a portion, functioning as a heat-generating portion, where the cross-sectional area is smaller than that of the remaining portion.

7. An igniter of a burner as claimed in claim 6, wherein said insulating layer is made of aluminum nitride, and said conductive ceramic layer includes silicon carbide and zirconium boride.

8. An igniter of a burner as claimed in claim 6, wherein said ceramic heater comprises:

(a) an insulating layer having a tip portion whose cross-sectional area is relatively small, and another portion whose cross-sectional area is relatively large, said another portion being integral with said tip portion;

(b) conductive ceramic layers continuously formed on both sides of said insulating layer and on an end surface of said tip portion of said insulating layer; and (c) a ceramic layer portion having a negative temperature coefficient, said ceramic layer portion being positioned between said conductive ceramic layers opposed at a portion of said another portion where the cross-sectional area of said insulating layer is large.

9. A circuit arrangement as claimed in claim 1, wherein said resistance-detecting means comprises three resistors forming a bridge circuit together with said ceramic heater.

10. A circuit arrangement as claimed in claim 1, wherein said feedback control means comprises a proportional-integral controller responsive to said resistance-detecting circuit.

11. A circuit arrangement as claimed in claim 10, wherein said feedback control means further comprises a subtractor responsive to an output signal from said proportional-integral controller and to an output signal from said current-detecting means.

12. A circuit arrangement as claimed in claim 9, further comprising a monitoring circuit responsive to an output signal from said resistance-detecting means and to an output signal from said current-detecting means for monitoring the life of said ceramic heater and providing a warning indication before said life ends when said resistance increases.

13. A circuit arrangement for an igniter of a burner, comprising:

(a) power source means arranged to control output current therefrom in accordance with a current control signal;

(b) a ceramic heater arranged to be energized by said power source means;

(c) resistance-detecting means for detecting the resistance of said ceramic heater;

(d) responsive means for being responsive to said resistance-detecting means for producing a first signal indicative of the variation in the resistance of said ceramic heater;

(e) current-detecting means for producing a second signal indicative of the amount of current fed from said power source means to said ceramic heater; and (f) control means having a subtractor responsive to said first and second signals for producing a difference thereof as said current control signal which is fed back to said power source means for controlling the current to said ceramic heater.

14. An igniter of a burner as claimed in claim 13, wherein said current-detecting means comprises elements constituting a bridge circuit together with said ceramic heater.

15. An igniter of a burner as claimed in claim 13, wherein said power circuit comprises semiconductor element arranged to be controlled by said feedback control means.

16. An igniter of a burner as claimed in claim 13, wherein said responsive means comprises an integrator responsive to said output signal from said resistance-detecting means.

17. An igniter of a burner as claimed in claim 13, further comprising a resistance-monitoring circuit for monitoring life of said ceramic heater using the resistance of said ceramic heater.

18. An igniter of a burner as claimed in claim 13, wherein said ceramic heater comprises an insulating layer and conductive ceramic layers formed on both sides of said insulating layer, said conductive ceramic layers having a portion, functioning as a heat-generating portion, where the cross-sectional area is smaller than that of the remaining portion.

19. An igniter of a burner as claimed in claim 18, wherein said insulating layer is made of aluminum nitride, and said conductive ceramic layers includes silicon carbide and zirconium boride.

20. An igniter of a burner as claimed in claim 13, wherein said ceramic heater comprises:

(a) an insulating layer having a tip portion whose cross-sectional area is relatively small, and another portion whose cross-sectional area is relatively large, said another portion being integral with said tip portion;

(b) conductive ceramic layers continuously formed on both sides of said insulating layer and on an end surface of said tip portion of said insulating layer; and (c) a ceramic layer portion having a negative temperature coefficient, said ceramic layer portion being positioned between said conductive ceramic layers opposed at a portion of said another portion where the cross-sectional area of said insulating layer is large.

21. A circuit arrangement as claimed in claim 13, wherien said resistance-detecting means comprises three resistors forming a bridge circuit together with said ceramic heater.

22. A circuit arrangement as claimed in claim 13, whererin said responsive means comprises a proportional-integral controller responsive to said resistance-detecting circuit.

23. A circuit arrangement as claimed in claim 13, further comprising a monitoring circuit responsive to an output signal from said resistance-detecting means and to an output signal from said current-detecting means for monitoring the life of said ceramic heater and providing warning indication before said life ends when said resistance increases.

* * * * *